US008409791B2

(12) United States Patent
Li et al.

(10) Patent No.: US 8,409,791 B2
(45) Date of Patent: Apr. 2, 2013

(54) DOUBLE-SIDED COLOR PHOTOGRAPHIC PAPER

(75) Inventors: Yaning Li, Baoding (CN); Yanfei Du, Baoding (CN); Jianguo Guo, Baoding (CN); Wengui Wang, Baoding (CN)

(73) Assignees: China Lucky Film Group Corporation, Baoding, Hebei Province (CN); Lucky Film Co., Ltd., Baoding, Hebei Province (CN)

( * ) Notice: Subject to any disclaimer, the term of this patent is extended or adjusted under 35 U.S.C. 154(b) by 0 days.

(21) Appl. No.: 13/132,113

(22) PCT Filed: Nov. 17, 2009

(86) PCT No.: PCT/CN2009/074987

§ 371 (c)(1), (2), (4) Date: Jun. 1, 2011

(87) PCT Pub. No.: WO2010/063212

PCT Pub. Date: Jun. 10, 2010

(65) Prior Publication Data

US 2011/0236829 A1 Sep. 29, 2011

(30) Foreign Application Priority Data

Dec. 2, 2008 (CN) ..... 2008 1 0079876

(51) Int. Cl.

| | |
|---|---|
| ***G03C 1/775*** | (2006.01) |
| ***G03C 1/815*** | (2006.01) |
| ***G03C 1/825*** | (2006.01) |
| ***G03C 1/76*** | (2006.01) |
| ***G03C 1/00*** | (2006.01) |

(52) U.S. Cl. ..... 430/538; 430/495.1; 430/496; 430/502; 430/503; 430/510; 430/523

(58) Field of Classification Search ..... 430/495.1, 430/496, 502, 503, 510, 523, 538
See application file for complete search history.

(56) References Cited

U.S. PATENT DOCUMENTS 4,645,731 A 2/1987 Bayless et al.

FOREIGN PATENT DOCUMENTS

| | | | |
|---|---|---|---|
| CN | 2807300 | Y | 8/2006 |
| CN | 101414113 | A | 4/2009 |
| CN | 201229465 | Y | 4/2009 |
| JP | 7219117 | A | 8/1995 |

*Primary Examiner* — Geraldina Visconti
(74) *Attorney, Agent, or Firm* — The Webb Law Firm

(57) ABSTRACT

Disclosed is a double-sided color photographic paper, including, in order, a first protection layer, a first photosensitive layer, a supporting substrate, a second photosensitive layer and a second protection layer. The supporting substrate has a first surface and a second surface opposite to the first surface. A first barrier layer and at least one layer of a first shading layer are sandwiched between the first photosensitive layer and the first surface of the supporting substrate. The first barrier layer is arranged between the first photosensitive layer and the first shading layer; a second barrier layer and at least one layer of a second shading layer are sandwiched between the second surface of the supporting substrate and the second photosensitive layer, and the second barrier layer is arranged between the second shading layer and the second photosensitive layer.

8 Claims, 1 Drawing Sheet

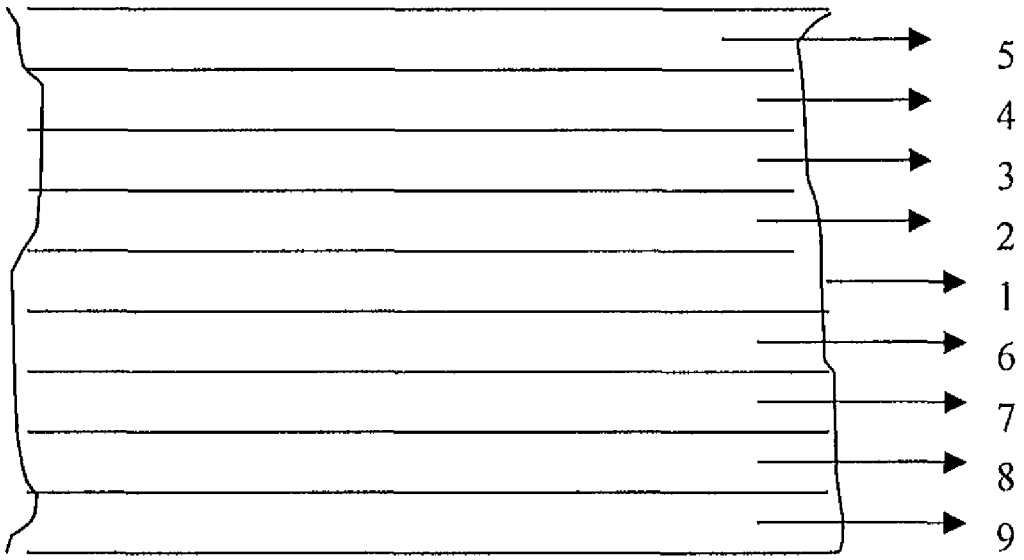
5
4
3
2
1
6
7
8
9

DOUBLE-SIDED COLOR PHOTOGRAPHIC PAPER

TECHNICAL FIELD

The present invention relates to a photographic material. More particularly, the present invention relates to a double-sided color photographic paper.

BACKGROUND ART

A conventional single-sided color photographic paper can be subjected to exposure on only one side to form a single-sided image, and no image can be formed on the reverse side. Thus, after the photographic paper is placed in a frame or an album, it can be viewed from the only one side on which the image is formed. Consequently, the applications of the photographic paper in the field of image carrier are restrained. Besides, a supporting substrate presented in the photographic paper does not get its full use, resulting in a high cost. In recent years, short-run is digital double-sided printing technology has been developed, and the market capacity thereof has been expanding rapidly. The dominant forms of the short-run digital double-sided printings are digital printing or ink-jet printing, and they can, on a limited plane carrier, provide consumers with twice as much as the graphic information provided by a conventional single-sided photosensitive color photographic paper. Therefore, the short-run digital double-sided printing has been widely used in applications such as business cards, personalized calendars, menus, brochures for an auction, specimen cards for a hotel, invitation cards, job cards, business promotional flyers, etc, which has brought huge losses and serious challenges to the traditional silver halide printing industry. However, despite that the short-run digital double-sided printing improves efficiency to a certain extent and meets the needs of individual consumer, it has shortcomings, including limited colors, narrow color gamut, poor image-gradation, poor resolution, long delivery cycle and high cost.

Chinese utility model patent No. ZL 200520023024.5 discloses a double-sided laser exposing enlarger and a double-sided photosensitive paper used thereby. The double-sided exposing enlarger comprises an exposing unit wherein two laser exposures are installed symmetrically on the upper and lower sides of the area where the photosensitive paper is to be exposed. A circuit control unit outputs scanning signals, and under the control of these scanning signals, both sides of the photosensitive paper are exposed by the laser exposures to form an image on each side. The exposed photosensitive paper is subsequently sent to a developing unit to be developed and enlarged. Through such a process, images are formed on both sides of the photosensitive paper. The photosensitive paper disclosed in No. ZL 200520023024.5 comprises a paper base, a first photosensitive layer, a first protective layer, a second photosensitive layer and a second protective layer, wherein the first photosensitive layer and the first protective layer are successively stacked on one side of the paper base, and the second photosensitive layer and the second protective layer are successively stacked on the other side of the paper base. With respect to and toward the paper base, the first photosensitive layer and the first protective layer are configured symmetrically with the second photosensitive layer and the second protective layer, respectively. The photosensitive layers and the protective layers are stacked by a well-known conventional method for producing color photographic paper. The photographic performance of the photosensitive papers thus produced is liable to be deteriorated due to the double-sided exposure, and such defects as an increased fog density and a decreased sensitivity would occur.

SUMMARY OF THE INVENTION

One technical problem to be solved by the present invention is to provide a double-sided color photographic paper which overcomes the above-mentioned defects in the prior art and which can bring about an image rich in color, broad in color gamut, manifold in image-gradation, high in resolution and efficiency, and low in cost.

To solve the above technical problem, the present invention provides the following technical solutions.

A double-sided color photographic paper, comprising in order a first protection layer, a first photosensitive layer, a supporting substrate, a second photosensitive layer and a second protection layer, the supporting substrate having a first surface and a second surface opposite to the first surface, characterized in that a first barrier layer and at least one layer of a first shading layer are sandwiched between the first photosensitive layer and the first surface of the supporting substrate, and the first barrier layer is arranged between the first photosensitive layer and the first shading layer; a second barrier layer and at least one layer of a second shading layer are sandwiched between the second surface of the supporting substrate and the second photosensitive layer, and the second barrier layer is arranged between the second shading layer and the second photosensitive layer; and with respect to and toward the supporting substrate, the first protection layer, the first photosensitive layer, the first barrier layer and the first shading layer are configured symmetrically with the second protection layer, the second photosensitive layer, the second barrier layer and the second shading layer, respectively.

According to the double-sided color photographic paper as mentioned above, each of the barrier layers has a thickness of 0.5 to 5 μm.

According to the double-sided color photographic paper as mentioned above, the material for forming each of the barrier layers comprises anti-stain agent and gelatin.

According to the double-sided color photographic paper as mentioned above, each of the shading layers has a thickness of 0.5 to 5 μm.

According to the double-sided color photographic paper as mentioned above, each of the shading layers is prepared from a coating composition comprising a shading material, an anti-stain agent, gelatin, and a stabilizer, and the coating amount of each of the components of the composition is as follows:

| | |
|---|---|
| shading material | 0.014 to 0.88 $g/m^2$; |
| anti-stain agent | 0.011 to 0.28 $g/m^2$; |
| gelatin | 0.21 to 5.65 $g/m^2$; and |
| stabilizer | 0.093 to 1.67 $g/m^2$. |

According to the double-sided photosensitive color photographic paper as mentioned above, said shading material is selected from the group consisting of: colloidal silver, anti-halation dyes, carbon black, and a combination thereof.

According to the double-sided photosensitive color photographic paper as mentioned above, each of the shading layers has a reflection density of 0.10 to 3.00.

According to the double-sided photosensitive color photographic paper as mentioned above, each of the photosensitive layers comprises three coats which are a red-sensitive layer, a green-sensitive layer and a blue-sensitive layer, said three coats are formed by uniformly coating an emulsion comprising a color-forming agent and a silver halide sensitive to the corresponding color light, respectively.

When a conventional single-sided photographic paper is subjected to exposure, the exposing light goes through an emulsion layer and then reaches a white paper base, wherein part of the light will be further transmitted through the white paper base while the rest will be reflected to the emulsion layer, thereby improving the sensitivity of the product. On the other hand, since both sides of the double-sided color photographic paper are coated with emulsions, when the photographic paper is exposed on one side, the light transmitted through the white paper base will cause the emulsion on the reverse side to be exposed, thus forming an interferential image which adversely affects the photographic performance of the photosensitive paper, and results in such defects as an increased fog density and decreased sensitivity. Therefore, the light transmitted through the white paper base must be eliminated. To solve this problem, a double-sided color photographic paper provided by the present invention comprises a shading layer, which contains a shading material so as to absorb part of the light transmitted through the white paper base and to prevent the emulsion on the unexposed side to be exposed to form the interferential image. However, although the shading material can absorb the light transmitted through the white paper base, the shading material also absorbs part of the light that should be reflected to the emulsion layer, which would lead to an insufficient exposure and deteriorate the photographic performance of the photosensitive paper. Consequently, the thickness of the shading layer and the amount of the shading material to be used should be suitably selected such that the light transmitted through the paper base is absorbed, and the exposure of the emulsion on the reverse side to form the interferential image is prevented. Meanwhile, the absorbance of the light that should be reflected to the emulsion layer is reduced as much as possible, and accordingly, the adverse effects on the photographic performance of the photosensitive paper are reduced as much as possible, either. Although it is not limited, the thickness of the shading layers according to the present invention is preferably 0.5 to 5 μm.

The shading material in the shading layers according to the present invention may be, but not limited to, one or more selected from the group consisting of colloidal silver, anti-halation dyes, carbon black, titanium dioxide, silicon dioxide, and aluminum powder. All the shading material is removed during a developing process, thus, the whiteness of the product is not adversely affected.

Colloidal silver is nano-scaled metal silver in a colloidal form, which takes on a grey appearance and absorbs all the visible light. Colloidal silver can be removed during the bleach or fixing process.

Colloidal silver can be prepared by the following described processes. For example, particles of colloidal simple-substance silver can be formed by reducing silver nitrate by a reductant to yield aggregates of a primary silver particle which functions as a core that grows larger along with the progress of the reduction to form a stable secondary particle, precipitating the secondary particle, washing the precipitate with water, and re-dissolving the washed precipitate. Alternatively, particles of colloidal simple-substance silver can be formed by firstly reacting silver nitrate with a halogen salt to yield silver halide particles, and then reacting the silver halide with a reductant and a developing accelerant.

Anti-halation dye is a dye which prevents light scattering within and between the emulsion layers such that the resolving power of the film is improved. Anti-halation dye is also known as internal anti-halation dye, and examples thereof include but are not limited to one or more compounds selected from the group consisting of those represented by the following Formulae Z-1 to Z-7, or a combination of the compounds represented by the following Formulae Z-1 to Z-7 (hereinafter, each structure is assigned a symbol, and each symbol assigned for a specific structure is given closely below the structure to be represented).

Z-1

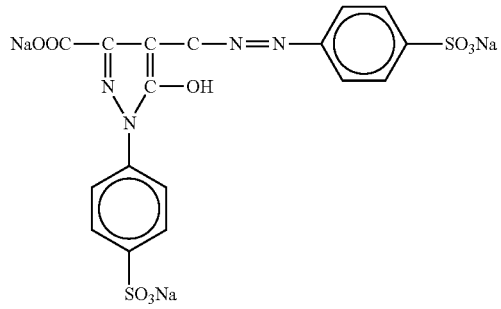

Z-2

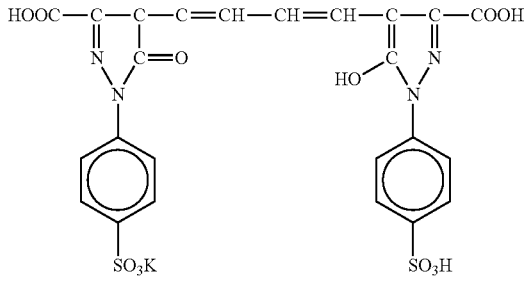

Z-3

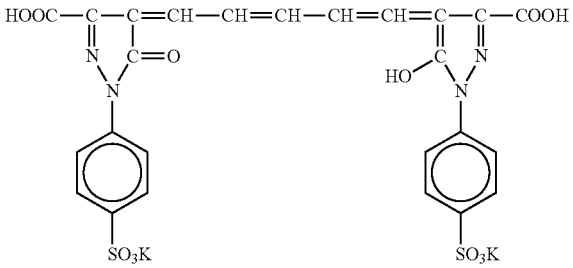

Z-4

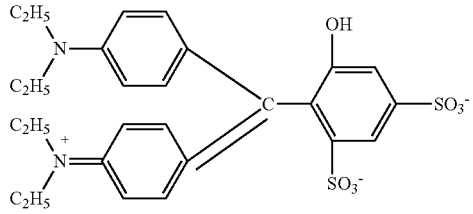

-continued

Z-5

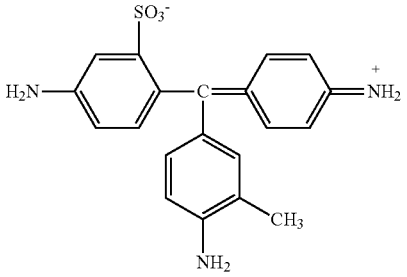

Z-6

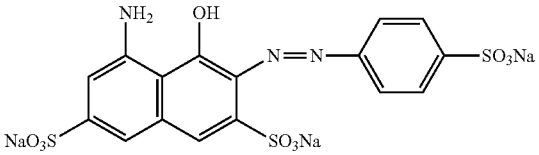

Z-7

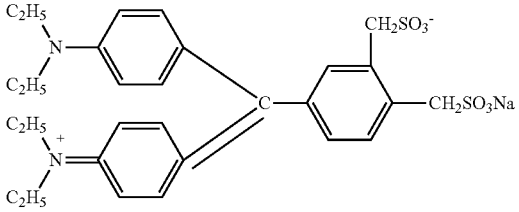

Carbon black is a fine powder produced by the incomplete combustion of a raw material containing carbon. Carbon black has extremely strong tinctorial strength and hiding power, and both of the tinctorial strength and hiding power, as well as anti-UV effect, increase with the decrease of the particle size of the carbon black particles. Carbon black can be removed for discoloration with water.

An anti-stain agent is a weakly reductive compound which reacts with quinonediimine that may be contained in the shading material and reduces quinonediimine to a compound having a structure of p-phenylenediamine. Thereby, quinonediimine loses the coupling activity, and cannot migrate into the adjacent emulsion layer. Thus, the stain of the adjacent emulsion layer and the fogging effect can be avoided. The anti-stain agent useful for the shading layer can be, but is not limited to, one or more selected from the group consisting of the following substances, or a combination of the following substances.

KB-1

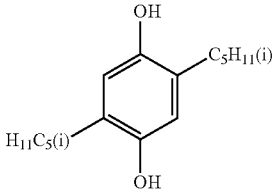

KB-2

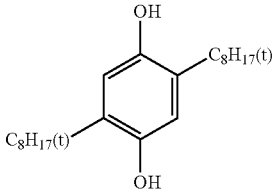

-continued

KB-3

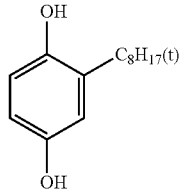

KB-4

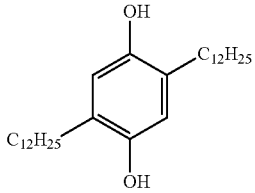

KB-5

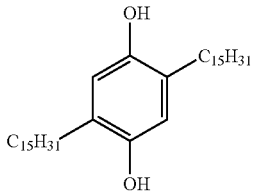

KB-6

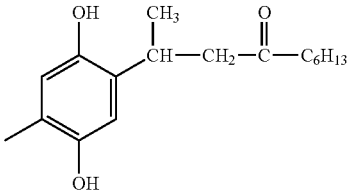

Stabilizers applicable for the present invention include:

W-1

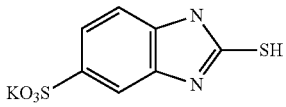

W-2

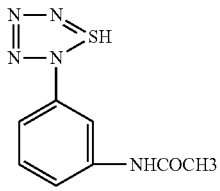

W-3

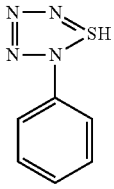

-continued

W-4

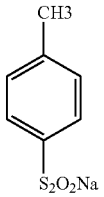

The shading effect of the shading layer is mainly achieved by the shading material. With respect to the same amount, different shading materials may provide the shading layer with different absorbances, and hence different reflection density. Therefore, the absorbing effect of the shading layer depends on the reflection density provided by the shading material. Preferably, the reflection density of the shading layer is in the range of 0.10 to 3.00. Herein, the so-called reflection density is the logarithm of the ratio of the amount of the incident light to the amount of the reflected light, which shows the shading ability of the shading layer.

During preparation of the photographic paper, quinonediimine ion which is an oxidation product in the developing process may remain in the shading material contained in the shading layer, and the remaining quinonediimine ion may migrate into the adjacent emulsion layer and couple with the coupler contained in a photosensitive layer, forming undesired color and causing fog to the product. To avoid the migration of quinonediimine, a barrier layer should be provided between the shading layer and the photosensitive layer. The barrier layer is a layer formed by hydrophilic gelatin and contains an anti-stain agent, wherein the anti-stain agent can be one or more selected from, but not limited to, the group consisting of KB-1, KB-2, KB-3, KB-4, KB-5, and KB-6, or a combination thereof.

According to the present invention, the thickness of the barrier layer is also a crucial factor to avoid the migration of quinonediimine. If the barrier layer is too thin, it would not function effectively to prevent the oxidation product in the developing process or the anti-halation dye in the shading layer from migrating into the adjacent photosensitive layer. On the other hand, if the barrier layer is too thick, it would adversely affect the penetration of the processing agents, resulting in an insufficient removal of the shading material, and impairing the whiteness of the product. The thickness of the barrier layer according to the present invention is preferably, but never limited to, 0.5 to 5 μm.

In the present invention, the photosensitive layer comprises three coatings which are a red-sensitive coating, a green-sensitive coating and a blue-sensitive coating, said three coatings are formed by uniformly coating an emulsion comprising a color-forming agent and a silver halide sensitive to the corresponding color light, respectively. The silver halide sensitive to the red, green or blue light used in the present invention can be prepared by a double jet emulsification technology known in the art, and can be sensitized with a chemical or sensitized with a spectrum by a sensitizing method known in the art. When preparing the emulsion, ions of the VIII group transition metal in the periodic table such as $Ir^{3+}$, $Rh^{3+}$, $OS^{3+}$ may be doped to improve the photographic properties of the emulsion. Besides, when preparing the emulsion, stabilizer, anti-fogging agent, or other additives may be added to improve the photographic properties of the emulsion.

All of the couplers for forming the red, green and blue colors, the anti-fading agent, the anti-stain agent, the ultraviolet absorbent, and the organic release agent used in the present invention are compounds known in the art, and they are dispersed in an aqueous solution of gelatin by a dispersing method known in the art. A dispersing agent such as sodium triisopropyl naphthy sulfonate, sodium dodecyl sulfate, sodium dodecyl benzene sulfonate, and sodium di(2-ethylhexyl)sulfosuccinate can be used. Useful solvents are esters having a high boiling point such as dibutyl phthalate, tricresyl phosphate, tributyl phosphate, tributyl citrate, and benzoate, and a combination thereof. Besides, a part of solvents having a low boiling point such as ethyl acetate can be added. The useful amount of each of the dispersing agent, the solvent having a high boiling point and the solvent having a low boiling point is the same as the content adopted in a conventional dispersing formulation.

According to the present invention, the anti-stain agent used in the photosensitive layer can be one or more selected from, but is not limited to, the group consisting of KB-1, KB-2, KB-3, KB-4, KB-5, and KB-6, or a combination thereof.

Examples of the coupler, the anti-fading agent, the stabilizer, the ultraviolet absorbent, the solvent having a high boiling point, which are useful in the photosensitive layer according to the present invention, are illustrated as follows.

Couplers include:

B1

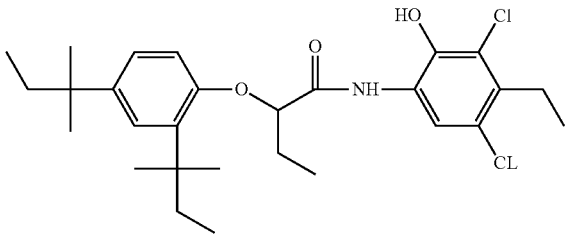

B2

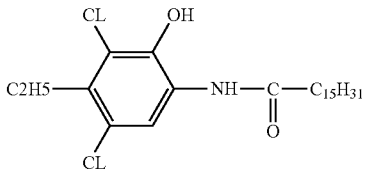

C1

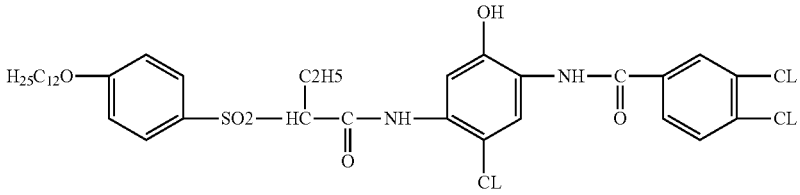

-continued
C2
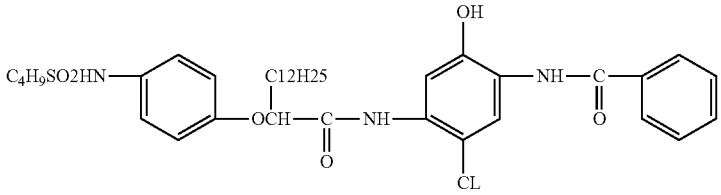
D1
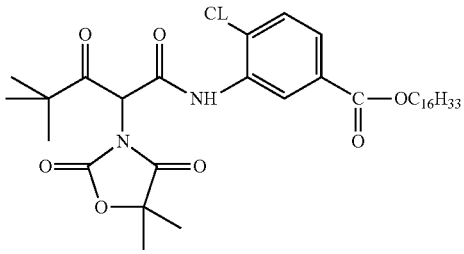
D2
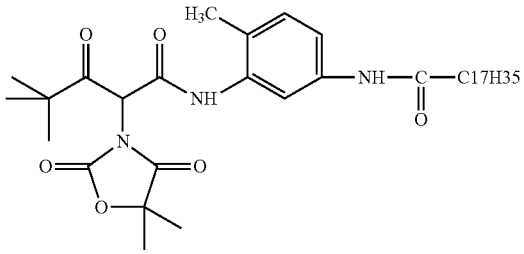
D3
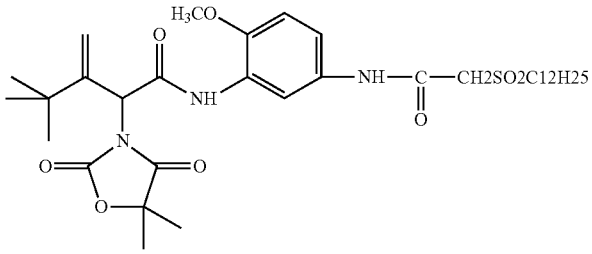
Anti-fading agents include:
E1
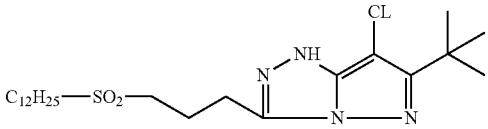
E2
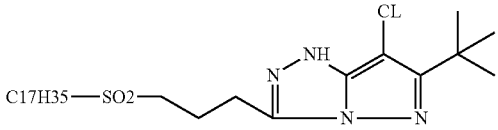
Stabilizers include:
F1
F2
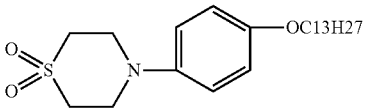
Solvents having a high boiling point include:
R1
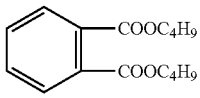
-continued
R2
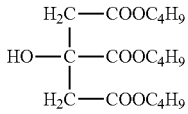
R3
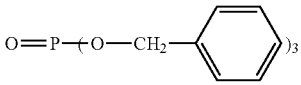
R4
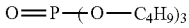
Ultraviolet absorbents include:
UV-1
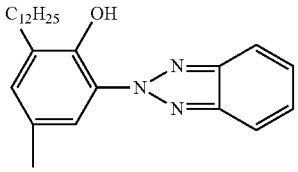
UV-2
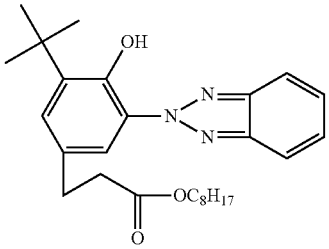
The protection layer is prepared from a hydrophilic gelatin. The protection layer mainly functions to prevent the photosensitive layer from being scratched during cropping, trimming, packaging, and processing. Further, several methods can be employed to improve the mechanical strength and the release property of the protection layer. These methods include the method in which the used gelatin is suitably selected; a polymer is used to replace with part of the gelatin; and a matting agent is added.

To improve the appearance and properties of the double-sided color photographic paper according to the present invention, additives such as a surfactant, a thickener, a stabilizer, and a hardener known in the art can be added.

In the present invention, the supporting substrate is not specifically limited, which can be any paper base for color photographic paper known in the art.

The double-sided color photographic paper provided by the present invention can be prepared by the following method.

Firstly, a coating composition for forming a shading layer (comprising a shading material, a photographic gelatin, and an anti-stain agent), and a coating composition for forming a barrier layer comprising a gelatin and an anti-stain agent are prepared. Then, a coating composition for forming a blue-sensitive layer, a coating composition for forming a green-sensitive layer, a coating composition for forming a red-sensitive layer and a coating composition for forming a first protection layer are prepared according to a method for producing a color photographic paper well known in the art. A supporting substrate having two surfaces, i.e., a first surface and a second surface opposite to the first surface, is provided. A first shading layer is uniformly applied onto the first surface of the supporting substrate by an extrusion coating method, then condensed, and dried. Secondly, a first barrier layer is uniformly applied on the surface of the substrate sample where the first shading layer is applied, then condensed, and dried. Thirdly, a first blue-sensitive layer, a first green-sensitive layer, a first red-sensitive layer and a first protection layer are successively and uniformly applied onto the surface of the substrate sample where the first shading layer and the first barrier layer have been applied, then condensed, and dried. After that, a second shading layer, a second barrier layer, a second blue-sensitive layer, a second green-sensitive layer, a second red-sensitive layer and a second protection layer are successively and uniformly applied onto the second surface of the supporting substrate, according to the same process for forming the above first shading layer, first barrier layer, first blue-sensitive layer, first green-sensitive layer, first red-sensitive layer and first protection layer, respectively, and then condensed and dried. Thereby, a double-sided color photographic paper sample is obtained.

Compared with the prior art, the double-sided color photographic paper provided by the present invention is richer in color, broader in color gamut, more manifold in image-gradation, higher in resolution and efficiency, and lower in cost.

BRIEF DESCRIPTION OF THE DRAWINGS

FIG. 1 is a schematic graph showing the structure of the double-sided color photographic paper provided by the present invention.

The numerals presented in FIG. 1 represent:

1 the supporting substrate
2 the first shading layer
3 the first barrier layer
4 the first photosensitive layer
5 the first protection layer
6 the second shading layer
7 the second barrier layer
8 the second photosensitive layer
9 the second protection layer

DETAILED DESCRIPTION OF EMBODIMENTS OF THE INVENTION

The present invention is further described referring to FIG. 1. The double-sided color photographic paper provided by the present invention comprises a supporting substrate 1, with a first shading layer 2, a first barrier layer 3, a first photosensitive layer 4 and a first protection layer 5 successively stacked on one side of the supporting substrate 1, and a second shading layer 6, a second barrier layer 7, a second photosensitive layer 8 and a second protection layer 9 successively stacked on the other side of the supporting substrate 1. With respect to and toward the supporting substrate 1, the first shading layer 2, the first barrier layer 3, the first photosensitive layer 4 and the first protection layer 5 are configured symmetrically with the second shading layer 6, the second barrier layer 7, the second photosensitive layer 8 and the second protection layer 9, respectively.

The double-sided color photographic paper provided by the present invention will be further described in form of Examples. Note that the Examples do not intend to limit the scope of the present invention.

EXAMPLE 1

| | coating amount (g/m$^2$) |
|---|---|
| first coat (the shading layer) | |
| colloidal silver | 0.014 |
| gelatin | 0.21 |
| anti-stain agent KB-2 | 0.011 |
| stabilizer W-1 | 0.093 |
| solvent R-1 | 0.0067 |
| solvent R-3 | 0.0033 |
| second coat (the barrier layer) | |
| gelatin | 0.0773 |
| anti-stain agent KB-2 | 0.0054 |
| solvent R-1 | 0.0034 |
| solvent R-3 | 0.0017 |
| thirdcoat (the blue-sensitive layer) | |
| blue-sensitive silver halide emulsion | 0.25 |
| gelatin | 1.20 |
| yellow coupler D1 | 10.43 |
| light stabilizer F1 | 0.10 |
| solvent R-1 | 0.30 |
| solvent R-2 | 0.20 |
| fourth coat (an interlayer) | |
| gelatin | 0.85 |
| anti-stain agent KB-2 | 0.09 |
| solvent R-1 | 0.06 |
| solvent R-3 | 0.03 |
| fifth coat (the green-sensitive layer) | |
| green-sensitive silver halide emulsion | 0.10 |
| gelatin | 1.00 |
| magenta coupler E1 | 0.25 |
| light stabilizer F1 | 0.20 |
| solvent R-1 | 0.10 |
| solvent R-4 | 0.05 |
| sixth coat (the ultraviolet-absorbing layer) | |
| gelatin | 0.80 |
| anti-stain agent KB-2 | 0.10 |
| ultraviolet absorbent UV-1 | 0.20 |
| ultraviolet absorbent UV-2 | 0.08 |
| solvent R-1 | 0.15 |
| solvent R-3 | 0.03 |
| solvent R-4 | 0.12 |
| seventh coat (the red-sensitive layer) | |
| red-sensitive silver halide emulsion | 0.17 |
| gelatin | 0.90 |
| cyan coupler B1 | 0.37 |
| ultraviolet absorbent UV-1 | 0.10 |
| solvent R-1 | 0.25 |
| solvent R-3 | 0.10 |

-continued

| | coating amount ($g/m^2$) |
|---|---|
| eighth coat (the ultraviolet absorbent layer) | |
| gelatin | 0.55 |
| anti-stain agent KB-2 | 0.03 |
| ultraviolet absorbent UV-1 | 0.16 |
| ultraviolet absorbent UV-2 | 0.04 |
| solvent R-1 | 0.09 |
| solvent R-3 | 0.02 |
| solvent R-4 | 0.05 |
| ninth coat (the protection layer) | |
| gelatin | 0.80 |
| surfactant J-1 | 0.22 |
| hardener H-1 | 0.12 |

Coating compositions for forming each of the above-listed first to ninth coats are respectively prepared according to the coating amount of each component listed in the above tables. A paper base having two surfaces, i.e., a first surface and a second surface opposite to the first surface, is provided to serve as the supporting substrate 1. The coating composition for forming the shading layer is uniformly applied onto the first surface of the supporting substrate by an extrusion coating method. The applied composition is condensed, and dried. The coating amount of the composition is adjusted such that the first shading layer 2 having a thickness of 0.5 μm and a density of 0.103 is formed. The thickness and the density are measured by a subtraction method. The coating composition for forming the barrier layer is uniformly applied on the surface of the first shading layer 2 obtained above. The applied composition is condensed, and dried. The coating amount of the composition is adjusted such that the first barrier layer 3 having a thickness of 0.5 μm is formed. The thickness is also measured by a subtraction method. Then the first RGB sensitive layer 4 (consisting of the blue-sensitive layer, the interlayer, the green-sensitive layer, the ultraviolet-absorbing layer, the red-sensitive layer and the ultraviolet absorbent layer), and the first protection layer 5 are successively formed on the surface of the first barrier layer 3 by repeating the steps of applying the coating compositions, and then condensing and drying the applied compositions for forming the above third to ninth coats, respectively. The second shading layer 6, the second barrier layer 7, the second RGB photosensitive layer 8 and the second protection layer 9 are successively formed on the second surface of the paper base, i.e., the supporting substrate 1, according to the same process for forming the above first shading layer 2, first barrier layer 3, first RGB photosensitive layer 4 and first protection layer 5, respectively. Thereby, a double-sided color photographic paper sample as illustrated by FIG. 1 is obtained.

The sample thus obtained is cut into several test strips according to a known standard specification, packed under dark environment, and then placed in a testing box having an inner environment of high temperature and high humidity (the temperature is 65° C., and the humidity is 80% RH), for 30 min. The strips are taken out and exposed with conventional exposure equipment. The strips upon exposure are developed according to a RA-4 processing technology known in the prior art. The photographic properties of strips are measured, and the results are summarized in Table 1. By comparing the results with the photographic properties of a conventional single-sided photosensitive color photographic paper sample, it can be seen, the photographic properties of the double-sided color photographic paper sample prepared according to the present invention are substantially equivalent to those of a standard specimen described below.

EXAMPLE 2

| | coating amount ($g/m^2$) |
|---|---|
| first coat (the shading layer) | |
| colloidal silver | 0.11 |
| gelatin | 1.45 |
| anti-stain agent KB-4 | 0.08 |
| stabilizer W-2 | 0.62 |
| solvent R-1 | 0.045 |
| solvent R-3 | 0.022 |
| second coat (the barrier layer) | |
| gelatin | 0.515 |
| anti-stain agent KB-4 | 0.036 |
| solvent R-1 | 0.023 |
| solvent R-3 | 0.012 |
| third coat (the blue-sensitive layer) | |
| blue-sensitive silver halide emulsion | 0.25 |
| gelatin | 1.20 |
| yellow coupler D2 | 10.43 |
| light stabilizer F1 | 0.10 |
| solvent R-1 | 0.30 |
| solvent R-2 | 0.20 |
| fourth coat (an interlayer) | |
| gelatin | 0.85 |
| anti-stain agent KB-2 | 0.09 |
| solvent R-1 | 0.06 |
| solvent R-3 | 0.03 |
| fifth coat (the green-sensitive layer) | |
| green-sensitive silver halide emulsion | 0.10 |
| gelatin | 1.00 |
| magenta coupler E2 | 0.25 |
| light stabilizer F1 | 0.20 |
| solvent R-1 | 0.10 |
| solvent R-4 | 0.05 |
| sixth coat (the ultraviolet-absorbing layer) | |
| gelatin | 0.80 |
| anti-stain agent KB-2 | 0.10 |
| ultraviolet absorbent UV-1 | 0.20 |
| ultraviolet absorbent UV-2 | 0.08 |
| solvent R-1 | 0.15 |
| solvent R-3 | 0.03 |
| solvent R-4 | 0.12 |
| seventh coat (the red-sensitive layer) | |
| red-sensitive silver halide emulsion | 0.17 |
| gelatin | 0.90 |
| cyan coupler B2 | 0.37 |
| ultraviolet absorbent UV-1 | 0.10 |
| solvent R-1 | 0.25 |
| solvent R-3 | 0.10 |
| eighth coat (the ultraviolet absorbent layer) | |
| gelatin | 0.55 |
| anti-stain agent KB-2 | 0.03 |
| ultraviolet absorbent UV-1 | 0.16 |
| ultraviolet absorbent UV-2 | 0.04 |
| solvent R-1 | 0.09 |
| solvent R-3 | 0.02 |
| solvent R-4 | 0.05 |
| ninth coat (the protection layer) | |
| gelatin | 0.80 |
| surfactant J-1 | 0.22 |
| hardener H-1 | 0.15 |

Coating compositions for forming each of the above-listed first to ninth coats are respectively prepared according to the coating amount of each component listed in the above tables.

A paper base having two surfaces, i.e., a first surface and a second surface opposite to the first surface, is provided to serve as the supporting substrate 1. The coating composition for forming the shading layer is uniformly applied onto the first surface of the supporting substrate by an extrusion coating method. The applied composition is condensed, and dried. The coating amount of the composition is adjusted such that the first shading layer 2 having a thickness of 2 μm and a density of 1.10 is formed. The thickness and the density are measured by a subtraction method. The coating composition for forming the barrier layer is uniformly applied on the surface of the first shading layer 2 obtained above. The applied composition is condensed, and dried. The coating amount of the composition is adjusted such that the first barrier layer 3 having a thickness of 2 μm is formed. The thickness is also measured by a subtraction method. Then the first RGB sensitive layer 4 (consisting of the blue-sensitive layer, the interlayer, the green-sensitive layer, the ultraviolet-absorbing layer, the red-sensitive layer and the ultraviolet absorbent layer), and the first protection layer 5 are successively formed on the surface of the first barrier layer 3 by repeating the steps of applying the coating compositions, and then condensing and drying the applied compositions for forming the above third to ninth coats, respectively. The second shading layer 6, the second barrier layer 7, the second RGB photosensitive layer 8 and the second protection layer 9 are successively formed on the second surface of the paper base, i.e., the supporting substrate 1, according to the same process for forming the above first shading layer 2, first barrier layer 3, first RGB photosensitive layer 4 and first protection layer 5, respectively. Thereby, a double-sided color photographic paper sample as illustrated by FIG. 1 is obtained.

The sample thus obtained is tested according to the same method as in Example 1, and the results are summarized in Table 1.

EXAMPLE 3

| | coating amount (g/m$^2$) |
|---|---|
| first coat (the shading layer) | |
| carbon black | 0.43 |
| gelatin | 2.17 |
| anti-stain agent KB-4 | 0.11 |
| stabilizer W-2 | 0.93 |
| solvent R-1 | 0.067 |
| solvent R-3 | 0.033 |
| second coat (the barrier layer) | |
| gelatin | 0.773 |
| anti-stain agent KB-4 | 0.054 |
| solvent R-1 | 0.034 |
| solvent R-3 | 0.017 |
| third coat (the blue-sensitive layer) | |
| blue-sensitive silver halide emulsion | 0.25 |
| gelatin | 1.20 |
| yellow coupler D2 | 10.43 |
| light stabilizer F1 | 0.10 |
| solvent R-1 | 0.30 |
| solvent R-2 | 0.20 |
| fourth coat (an interlayer) | |
| gelatin | 0.85 |
| anti-stain agent KB-2 | 0.09 |
| solvent R-1 | 0.06 |
| solvent R-3 | 0.03 |

-continued

| | coating amount (g/m$^2$) |
|---|---|
| fifth coat (the green-sensitive layer) | |
| green-sensitive silver halide emulsion | 0.10 |
| gelatin | 1.00 |
| magenta coupler E2 | 0.25 |
| light stabilizer F1 | 0.20 |
| solvent R-1 | 0.10 |
| solvent R-4 | 0.05 |
| sixth coat (the ultraviolet-absorbing layer) | |
| gelatin | 0.80 |
| anti-stain agent KB-2 | 0.10 |
| ultraviolet absorbent UV-1 | 0.20 |
| ultraviolet absorbent UV-2 | 0.08 |
| solvent R-1 | 0.15 |
| solvent R-3 | 0.03 |
| solvent R-4 | 0.12 |
| seventh coat (the red-sensitive layer) | |
| red-sensitive silver halide emulsion | 0.17 |
| gelatin | 0.90 |
| cyan coupler B2 | 0.37 |
| ultraviolet absorbent UV-1 | 0.10 |
| solvent R-1 | 0.25 |
| solvent R-3 | 0.10 |
| eighth coat (the ultraviolet absorbent layer) | |
| gelatin | 0.55 |
| anti-stain agent KB-2 | 0.03 |
| ultraviolet absorbent UV-1 | 0.16 |
| ultraviolet absorbent UV-2 | 0.04 |
| solvent R-1 | 0.09 |
| solvent R-3 | 0.02 |
| solvent R-4 | 0.05 |
| ninth coat (the protection layer) | |
| gelatin | 0.80 |
| surfactant J-1 | 0.22 |
| hardener H-1 | 0.17 |

Coating compositions for forming each of the above-listed first to ninth coats are respectively prepared according to the coating amount of each component listed in the above tables. A paper base having two surfaces, i.e., a first surface and a second surface opposite to the first surface, is provided to serve as the supporting substrate 1. The coating composition for forming the shading layer is uniformly applied onto the first surface of the supporting substrate by an extrusion coating method. The applied composition is condensed, and dried. The coating amount of the composition is adjusted such that the first shading layer 2 having a thickness of 3 μm and a density of 1.60 is formed. The thickness and the density are measured by a subtraction method. The composition for forming the barrier layer is uniformly applied on the surface of the first shading layer 2 obtained above. The applied composition is condensed, and dried. The coating amount of the composition is adjusted such that the first barrier layer 3 having a thickness of 3 μm is formed. The thickness is also measured by a subtraction method. Then the first RGB sensitive layer 4 (consisting of the blue-sensitive layer, the interlayer, the green-sensitive layer, the ultraviolet-absorbing layer, the red-sensitive layer and the ultraviolet absorbent layer), and the first protection layer 5 are successively formed on the surface of the first barrier layer 3 by repeating the steps of applying the coating compositions, and then condensing and drying the applied compositions for forming the above third to ninth coats, respectively. The second shading layer 6, the second barrier layer 7, the second RGB photosensitive layer 8 and the second protection layer 9 are successively formed on the second surface of the paper base, i.e., the supporting substrate 1, according to the same process for forming the above first shading layer 2, first barrier layer 3, first RGB photosensitive layer 4 and first protection layer 5, respectively. Thereby, a double-sided color photographic paper sample as illustrated by FIG. 1 is obtained.

The sample thus obtained is tested according to the same method as in Example 1, and the results are summarized in Table 1.

EXAMPLE 4

| | coating amount (g/m$^2$) |
|---|---|
| first coat (the shading layer) | |
| yellow anti-halation dye Z-1 | 0.30 |
| magenta anti-halation dye Z-2 | 0.15 |
| cyan anti-halation dye Z-3 | 0.18 |
| gelatin | 4.52 |
| anti-stain agent KB-2 | 0.20 |
| stabilizer | 1.17 |
| solvent R-1 | 0.128 |
| solvent R-3 | 0.059 |
| second coat (the barrier layer) | |
| gelatin | 0.90 |
| anti-stain agent KB-2 | 0.065 |
| solvent R-1 | 0.041 |
| solvent R-3 | 0.024 |
| third coat (the blue-sensitive layer) | |
| blue-sensitive silver halide emulsion | 0.25 |
| gelatin | 1.20 |
| yellow coupler D | 10.43 |
| light stabilizer F1 | 0.10 |
| solvent R-1 | 0.30 |
| solvent R-2 | 0.20 |
| fourth coat (an interlayer) | |
| gelatin | 0.85 |
| anti-stain agent KB-2 | 0.09 |
| solvent R-1 | 0.06 |
| solvent R-3 | 0.03 |
| fifth coat (the green-sensitive layer) | |
| green-sensitive silver halide emulsion | 0.10 |
| gelatin | 1.00 |
| magenta coupler E1 | 0.25 |
| light stabilizer F1 | 0.20 |
| solvent R-1 | 0.10 |
| solvent R-4 | 0.05 |
| sixth coat (the ultraviolet-absorbing layer) | |
| gelatin | 0.80 |
| anti-stain agent KB-2 | 0.10 |
| ultraviolet absorbent UV-1 | 0.20 |
| ultraviolet absorbent UV-2 | 0.08 |
| solvent R-1 | 0.15 |
| solvent R-3 | 0.03 |
| solvent R-4 | 0.12 |
| seventh coat (the red-sensitive layer) | |
| red-sensitive silver halide emulsion | 0.17 |
| gelatin | 0.90 |
| cyan coupler B1 | 0.37 |
| ultraviolet absorbent UV-1 | 0.10 |
| solvent R-1 | 0.25 |
| solvent R-3 | 0.10 |
| eighth coat (the ultraviolet absorbent layer) | |
| gelatin | 0.55 |
| anti-stain agent KB-2 | 0.03 |
| ultraviolet absorbent UV-1 | 0.16 |
| ultraviolet absorbent UV-2 | 0.04 |
| solvent R-1 | 0.09 |
| solvent R-3 | 0.02 |
| solvent R-4 | 0.05 |

-continued

| | coating amount (g/m$^2$) |
|---|---|
| ninth coat (the protection layer) | |
| gelatin | 0.80 |
| surfactant J-1 | 0.22 |
| hardener H-1 | 0.19 |

Coating compositions for forming each of the above-listed first to ninth coats are respectively prepared according to the coating amount of each component listed in the above tables. A paper base having two surfaces, i.e., a first surface and a second surface opposite to the first surface, is provided to serve as the supporting substrate 1. The coating composition for forming the shading layer is uniformly applied onto the first surface of the supporting substrate by an extrusion coating method. The applied composition is condensed, and dried. The coating amount of the composition is adjusted such that the first shading layer 2 having a thickness of 4 μm and a density of 2.11 is formed. The thickness and the density are measured by a subtraction method. The composition for forming the barrier layer is uniformly applied on the surface of the first shading layer 2 obtained above. The applied composition is condensed, and dried. The coating amount of the composition is adjusted such that the first barrier layer 3 having a thickness of 4 μm is formed. The thickness is also measured by a subtraction method. Then the first RGB sensitive layer 4 (consisting of the blue-sensitive layer, the interlayer, the green-sensitive layer, the ultraviolet-absorbing layer, the red-sensitive layer and the ultraviolet absorbent layer), and the first protection layer 5 are successively formed on the surface of the first barrier layer 3 by repeating the steps of applying, condensing, and drying the compositions for forming the above third to ninth coats, respectively. The second shading layer 6, the second barrier layer 7, the second RGB photosensitive layer 8 and the second protection layer 9 are successively formed on the second surface of the paper base, i.e., the supporting substrate 1, according to the same process for forming the above first shading layer 2, first barrier layer 3, first RGB photosensitive layer 4 and first protection layer 5, respectively. Thereby, a double-sided color photographic paper sample as illustrated by FIG. 1 is obtained.

The sample thus obtained is tested according to the same method as in Example 1, and the results are summarized in Table 1.

EXAMPLE 5

| | coating amount (g/m$^2$) |
|---|---|
| first coat (the shading layer) | |
| yellow anti-halation dye Z-1 | 0.42 |
| magenta anti-halation dye Z-5 | 0.21 |
| cyan anti-halation dye Z-4 | 0.25 |
| gelatin | 5.65 |
| anti-stain agent KB-2 | 0.28 |
| stabilizer | 1.67 |
| solvent R-1 | 0.181 |
| solvent R-3 | 0.084 |
| second coat (the barrier layer) | |
| gelatin | 1.28 |
| anti-stain agent KB-2 | 0.092 |
| solvent R-1 | 0.058 |
| solvent R-3 | 0.034 |

-continued

| | coating amount ($g/m^2$) |
|---|---|
| third coat (the blue-sensitive layer) | |
| blue-sensitive silver halide emulsion | 0.25 |
| gelatin | 1.20 |
| yellow coupler D | 10.43 |
| light stabilizer 1 | 0.10 |
| solvent R-1 | 0.30 |
| solvent R-2 | 0.20 |
| fourth coat (an interlayer) | |
| gelatin | 0.85 |
| anti-stain agent KB-2 | 0.09 |
| solvent R-1 | 0.06 |
| solvent R-3 | 0.03 |
| fifth coat (the green-sensitive layer) | |
| green-sensitive silver halide emulsion | 0.10 |
| gelatin | 1.00 |
| magenta coupler E1 | 0.25 |
| light stabilizer F1 | 0.20 |
| solvent R-1 | 0.10 |
| solvent R-4 | 0.05 |
| sixth coat (the ultraviolet-absorbing layer) | |
| gelatin | 0.80 |
| anti-stain agent KB-2 | 0.10 |
| ultraviolet absorbent UV-1 | 0.20 |
| ultraviolet absorbent UV-2 | 0.08 |
| solvent R-1 | 0.15 |
| solvent R-3 | 0.03 |
| solvent R-4 | 0.12 |
| seventh coat (the red-sensitive layer) | |
| red-sensitive silver halide emulsion | 0.17 |
| gelatin | 0.90 |
| cyan coupler B1 | 0.37 |
| ultraviolet absorbent UV-1 | 0.10 |
| solvent R-1 | 0.25 |
| solvent R-3 | 0.10 |
| eighth coat (the ultraviolet absorbent layer) | |
| gelatin | 0.55 |
| anti-stain agent KB-2 | 0.03 |
| ultraviolet absorbent UV-1 | 0.16 |
| ultraviolet absorbent UV-2 | 0.04 |
| solvent R-1 | 0.09 |
| solvent R-3 | 0.02 |
| solvent R-4 | 0.05 |
| ninth coat (the protection layer) | |
| gelatin | 0.80 |
| surfactant J-1 | 0.22 |
| hardener H-1 | 0.22 |

Coating compositions for forming each of the above-listed first to ninth coats are respectively prepared according to the coating amount of each component listed in the above tables. A paper base having two surfaces, i.e., a first surface and a second surface opposite to the first surface, is provided to serve as the supporting substrate 1. The coating composition for forming the shading layer is uniformly applied onto the first surface of the supporting substrate by an extrusion coating method. The applied composition is condensed, and dried. The coating amount of the composition is adjusted such that the first shading layer 2 having a thickness of 5 μm and a density of 3.01 is formed. The thickness and the density are measured by a subtraction method. The composition for forming the barrier layer is uniformly to applied on the surface of the first shading layer 2 obtained above. The applied composition is condensed, and dried. The coating amount of the composition is adjusted such that the first barrier layer 3 having a thickness of 5 μm is formed. The thickness is also measured by a subtraction method. Then the first RGB sensitive layer 4 consisting of (the blue-sensitive layer, the interlayer, the green-sensitive layer, the ultraviolet-absorbing layer, the red-sensitive layer and the ultraviolet absorbent layer), and the first protection layer 5 are successively formed on the surface of the first barrier layer 3 by repeating the steps of applying the coating compositions, and then condensing and drying the compositions for forming the above third to ninth coats, respectively. The second shading layer 6, the second barrier layer 7, the second RGB photosensitive layer 8 and the second protection layer 9 are successively formed on the second surface of the paper base, i.e., the supporting substrate 1, according to the same process for forming the above first shading layer 2, first barrier layer 3, first RGB photosensitive layer 4 and first protection layer 5, respectively. Thereby, a double-sided color photographic paper sample as illustrated by FIG. 1 is obtained.

The sample thus obtained is tested according to the same method as in Example 1, and the results are summarized in Table 1.

TABLE 1

| | photographic properties | | | | |
|---|---|---|---|---|---|
| | | minimum density | contrast | speed (in ISO value) | maximum density |
| single-sided photographic paper as a standard specimen | the blue-sensitive layer | 0.09 | 40 | 100 | 2.00 |
| | the green-sensitive layer | 0.10 | 40 | 100 | 2.00 |
| | the red-sensitive layer | 0.10 | 40 | 100 | 2.00 |
| Example 1 | the blue-sensitive layer | 0.10 | 39 | 97 | 1.98 |
| | the green-sensitive layer | 0.11 | 38 | 98 | 1.99 |
| | the red-sensitive layer | 0.11 | 40 | 99 | 2.00 |
| Example 2 | the blue-sensitive layer | 0.10 | 38 | 97 | 1.97 |
| | the green-sensitive layer | 0.11 | 37 | 97 | 1.98 |
| | the red-sensitive layer | 0.10 | 39 | 98 | 1.98 |
| Example 3 | the blue-sensitive layer | 0.09 | 39 | 97 | 1.97 |
| | the green-sensitive layer | 0.10 | 39 | 97 | 1.97 |
| | the red-sensitive layer | 0.10 | 38 | 98 | 1.98 |
| Example 4 | the blue-sensitive layer | 0.10 | 37 | 97 | 1.99 |
| | the green-sensitive layer | 0.10 | 39 | 97 | 1.97 |
| | the red-sensitive layer | 0.11 | 38 | 98 | 1.98 |
| Example 5 | the blue-sensitive layer | 0.10 | 37 | 96 | 1.96 |
| | the green-sensitive layer | 0.10 | 37 | 98 | 1.97 |
| | the red-sensitive layer | 0.10 | 37 | 97 | 1.98 |

In Table 1, the minimum density is the color density when the exposure value equals 0. The speed is the reciprocal value of the exposure value required to achieve a color density 0.6 higher than the minimum density, and is given as a relative value. The speed of the single-sided photographic paper as a standard specimen is 100. The contrast is the difference between the logarithm of the exposure value required to achieve a color density of 0.7 and that of the exposure value required to achieve a color density of 1.7. The contrast of the single-sided photographic paper is 40. The maximum density is a color density where the differential coefficient of the color density with respect to the logarithm of the required exposure value is no more than 0.05. The maximum density of the single-sided photographic paper is 2.00.

It can be seen from the data in Table 1, the double-sided photographic paper produced according to the present invention has photographic properties substantially equivalent to those of the single-sided photographic paper, and is applicable for a double-sided exposing color enlarger. Using such double-sided photographic paper, double-sided images can be obtained which are as rich in color, broad in color gamut, manifold in image-gradation, and high in resolution, as the image obtained on a conventional single-sided photographic paper. Besides, using the double-sided photographic paper produced according to the present invention, the exposing efficiency is improved, the cost is reduced, and the paper pulp resource is saved. Besides, the double-sided photographic paper produced according to the present invention is favorable for environment protection, easy to put into practical use, and is convenient for viewing, binding and using.

The invention claimed is:

1. A double-sided color photographic paper, comprising, in order, a first protection layer, a first photosensitive layer, a supporting substrate, a second photosensitive layer and a second protection layer, the supporting substrate having a first surface and a second surface opposite to the first surface, wherein a first barrier layer and at least one layer of a first shading layer are sandwiched between the first photosensitive layer and the first surface of the supporting substrate, and the first barrier layer is arranged between the first photosensitive layer and the first shading layer;

a second barrier layer and at least one layer of a second shading layer are sandwiched between the second surface of the supporting substrate and the second photosensitive layer, and the second barrier layer is arranged between the second shading layer and the second photosensitive layer;

with respect to and toward the supporting substrate, the first protection layer, the first photosensitive layer, the first barrier layer and the first shading layer are configured symmetrically with the second protection layer, the second photosensitive layer, the second barrier layer and the second shading layer, respectively, and each of the shading layers is prepared from a coating composition comprising a shading material, an anti-stain agent, gelatin, and a stabilizer.

2. The double-sided color photographic paper according to claim 1, wherein each of the barrier layers has a thickness of 0.5 to 5 μm.

3. The double-sided color photographic paper according to claim 2, wherein the material for forming each of the barrier layers comprises anti-stain agent and gelatin.

4. The double-sided color photographic paper according to claim 3, wherein each of the shading layers has a thickness of 0.5 to 5 μm.

5. The double-sided color photographic paper according to claim 1, wherein the coating amount of each of the components of the coating composition is as follows:

| | |
|---|---|
| shading material | 0.014 to 0.88 $g/m^2$; |
| anti-stain agent | 0.011 to 0.28 $g/m^2$; |
| gelatin | 0.21 to 5.65 $g/m^2$; and |
| stabilizer | 0.093 to 1.67 $g/m^2$. |

6. The double-sided color photographic paper according to claim 5, wherein said shading material is selected from the group consisting of: colloidal silver, anti-halation dyes, carbon black, titanium dioxide, silicon dioxide, aluminum powder, and a combination thereof.

7. The double-sided color photographic paper according to claim 6, wherein each of the shading layers has a reflection density of 0.10 to 3.00.

8. The double-sided color photographic paper according to claim 7, wherein the photosensitive layer comprises three coats which are a red-sensitive layer, a green-sensitive layer and a blue-sensitive layer, said three coats are formed by uniformly coating an emulsion comprising a coupler and a silver halide sensitive to the corresponding color light, respectively.

* * * * *